US009360256B2

(12) United States Patent
Li

(10) Patent No.: US 9,360,256 B2
(45) Date of Patent: Jun. 7, 2016

(54) ENERGY EFFICIENT FURNACE WITH COAXIAL SEGMENTED CENTER HEARTH AND MULTIPLE COMBUSTION STAGES WITH REGENERATIVE HEAT RETURN

(71) Applicant: Hengjie Li, Shenzhen (CN)

(72) Inventor: Hengjie Li, Shenzhen (CN)

(73) Assignee: Heng Kai Development Limited, Hong Kong (CN)

( * ) Notice: Subject to any disclaimer, the term of this patent is extended or adjusted under 35 U.S.C. 154(b) by 270 days.

(21) Appl. No.: 14/124,251

(22) PCT Filed: Oct. 14, 2012

(86) PCT No.: PCT/CN2012/082931

§ 371 (c)(1),
(2) Date: Dec. 6, 2013

(87) PCT Pub. No.: WO2013/060241

PCT Pub. Date: May 2, 2013

(65) Prior Publication Data

US 2014/0127636 A1 May 8, 2014

(30) Foreign Application Priority Data

Oct. 28, 2011 (CN) ..... 2011 1 0335470

(51) Int. Cl.
*F27B 3/04* (2006.01)
*F27D 17/00* (2006.01)
(Continued)

(52) U.S. Cl.
CPC ..... *F27D 17/002* (2013.01); *F27B 9/02* (2013.01); *F27B 9/38* (2013.01); *F27B 9/39* (2013.01);
(Continued)

(58) Field of Classification Search
CPC ..... F23L 15/02; F23L 15/04; F23G 7/066; F27B 9/061; F27B 9/068; F27B 17/0016; F27B 3/04; F27B 3/045
USPC ..... 432/174, 179, 180, 181, 186, 191, 195
See application file for complete search history.

(56) References Cited

U.S. PATENT DOCUMENTS 2,494,415 A * 1/1950 Sosman ..... F27B 3/20 266/214
2,504,379 A * 4/1950 Bloom ..... C21D 9/70 432/181

(Continued)

*Primary Examiner* — Gregory A Wilson
(74) *Attorney, Agent, or Firm* — Michael D. Eisenberg

(57) ABSTRACT

Disclosed in the present invention are a combustion furnace with coaxial staged hearth and heating method thereof, in which the combustion furnace comprises a metal furnace body (40) whose internal part is provided with a furnace chamber. The furnace chamber is divided into two sections at the middle by fire resistant material to form a left and a right independent combustion chambers (18, 19). Two independent combustion chambers (18, 19) are respectively connected with the ends of flue gas chambers (2, 60), while the other ends of the flue gas chambers (2, 60) are respectively connected with a burner (3). The peripherals of two independent combustion chambers (18, 19) are respectively provided with a flue gas heat radiation pipe (14). A middle flue gas chamber (100) is set in the middle position of the furnace chamber. Two ends of the flue gas heat radiation pipe (14) are respectively connected with the flue gas chamber (2, 60) and the middle flue gas chamber (100). Two independent combustion chambers (18, 19) are communicated with each other through the flue gas chamber (2, 60), the flue gas heat radiation pipe (14) and the middle flue gas chamber (100), and combust alternately. A suspension device including a portal frame (50) is provided for suspending the metal furnace body (40) horizontally or obliquely. The metal furnace body (40) is suspended on the portal frame (50) at a suspending point (41). A walking mechanism (20) and a feeding mechanism (9) are also set on the portal frame (50).

9 Claims, 17 Drawing Sheets

(51) Int. Cl.

| | |
|---|---|
| ***F27B 17/00*** | (2006.01) |
| ***F27B 19/02*** | (2006.01) |
| ***F27B 9/38*** | (2006.01) |
| ***F27B 9/39*** | (2006.01) |
| ***F27D 15/02*** | (2006.01) |
| ***F27B 9/02*** | (2006.01) |
| ***F27D 99/00*** | (2010.01) |

(52) U.S. Cl.

CPC ..... *F27B 17/0016* (2013.01); *F27B 19/02* (2013.01); *F27D 15/0206* (2013.01); *F27D 17/004* (2013.01); *F27D 99/0033* (2013.01); *F27D 2017/007* (2013.01)

(56) References Cited

U.S. PATENT DOCUMENTS

| | | | | | |
|---|---|---|---|---|---|
| 3,783,309 | A * | 1/1974 | Alibert | G01K 1/024 | 310/319 |
| 4,336,770 | A * | 6/1982 | Kaneko | F28D 7/12 | 122/130 |
| 6,109,914 | A * | 8/2000 | Matsuo | C12D 1/767 | 432/179 |
| 2005/0235926 | A1 * | 10/2005 | Thielert | C01B 17/0447 | 122/13.01 |

* cited by examiner

ENERGY EFFICIENT FURNACE WITH COAXIAL SEGMENTED CENTER HEARTH AND MULTIPLE COMBUSTION STAGES WITH REGENERATIVE HEAT RETURN

FIELD OF THE INVENTION

The invention relates to a gas/oil furnace, mainly to an energy efficient furnace with coaxial segmented center hearth and multiple combustion stages with regenerative heat return, which can be used for reducing metal, heating water or producing the steam etc.

BACKGROUND OF THE INVENTION

The traditional process of refining magnesium adopts the Pidgeon method. The method uses a horizontal furnace. The furnace body is laid on the base with refractory bricks. A plurality of reduction tanks are laid and distributed in the furnace. The reduction tank is filled with reactant pellets. Firstly, the reduction tank is heated with radiant heat from a hearth outside of the reduction tank; secondly, the heat is radiated and transmitted to the reactant pellets by the reduction tank; finally, the heat is transmitted by the reactant pellets through a mutual relay method. It is a peripheral heating. It has been proved that: as to the method of heating from a big hearth built by laying refractory bricks, there are a big space in the hearth, big transmitting radius of heat radiation and a blind angle of high-temperature convection flue gas, resulting in low heat transfer rate, large temperature gradient, bad temperature uniformity, and large radius of heat radiation transfer; thus, it costs too much time (10-12 hours) to make feeds in the reduction tank reach the reduction temperature of 1150-1200 DEG C according to technological requirements. The reduction tank is easy to generate thermal creep due to uneven heating, and is scrapped after being used about 2 months. Furthermore, each reduction tank can only accommodate hundreds kilograms of feeds due to its small volume. Consequently, we need to invest on many furnaces and reduction tanks in order to reach the requirements for production capacity. Therefore, the reduction furnace built by laying refractory bricks has the disadvantages of large floor space, low production efficiency, high labor intensity, high energy consumption, low magnesium reduction rate, serious environmental pollution, short service life of the reduction tank, and unavailability for mechanical or automated loading and unloading.

SUMMARY OF THE INVENTION

The objective of the invention is to provide an energy efficient furnace with coaxial segmented center hearth and multiple combustion stages with regenerative heat return, a furnace body adopts a metal furnace body, the metal furnace body is hanged on a portal frame, a furnace chamber adopts a method of thermal storage and preheating by alternate combustion in a dual combustion chamber, the heat transfer area is increased by regenerative heat return and multiple combustion stages, hot flue gas in the furnace chamber is fully recycled and reused, the conventional external heating method is changed, achieving the objectives of fast heating, energy saving, high efficiency, and small floor area, and preferably overcoming the deficiencies of the existing gas furnace.

The technical proposal of the invention is as follows: the furnace comprises: a metal furnace body whose internal part is provided with a furnace chamber. The furnace chamber is divided into two sections at the middle by fire resistant material to form a left and a right independent combustion chambers. Two independent combustion chambers are respectively connected with the ends of flue gas chambers, while the other ends of the flue gas chambers are respectively connected with a burner. The peripherals of two independent combustion chambers are respectively provided with a flue gas heat radiation pipe. A middle flue gas chamber is arranged in the middle position of the furnace chamber. Two ends of the flue gas heat radiation pipe are respectively connected with the flue gas chamber and the middle flue gas chamber. Two independent combustion chambers are communicated with each other through the flue gas chamber, the flue gas heat radiation pipe and the middle flue gas chamber, and combust alternately. When one combustion chamber combusts, the other combustion chamber stops combusting. Hot flue gas produced by the combustion chamber is sucked into a heat-transfer device of a heat storage body through the flue gas chamber, the flue gas heat radiation pipe, the middle flue gas chamber, the heat radiation pipe, the flue gas chamber and the non-burning burner. A loading inlet and a crystal collector are arranged on the metal furnace body, a discharge port is arranged below the metal furnace body, and a suspending point is arranged on the surface of the metal furnace body;

a suspension device for suspending the metal furnace body horizontally or obliquely, includes a portal frame; the metal furnace body is suspended on the portal frame at a suspending point; a walking mechanism and a feeding mechanism are also arranged on the portal frame;

a burner, including a nozzle, wherein the nozzle is provided with an igniter, a fuel inlet, a hot flue-gas inlet and a hot flue-gas outlet, wherein the hot flue-gas inlet and the hot flue-gas outlet are respectively connected with the heat-transfer device of a heat storage body.

The technical proposal also comprises:

Both ends of the metal furnace body are respectively connected to a sealing head, the metal furnace body is tightly fixed with the sealing head by a quick locker and a tightener; the flue gas chamber is fixed inside the sealing head by a bushing; a seal cartridge is arranged between the flue gas chamber and the bushing of the sealing head; wherein, a connection flange is respectively arranged at both ends of the metal furnace body, the connection flange is provided with a wedge-shaped surface; the sealing head is provided with a flange of the sealing head, the flange of the sealing head is provided with a wedge-shaped surface; a cooling water channel is arranged on the connection surface between the connection flange and the flange of the sealing head, a cool water inlet and a cool water outlet which are communicated with the cooling water channel are respectively arranged on the connection flange and the flange of the sealing head;

the quick locker is provided with a quick latch segment; a V-shaped groove and a locking hole are arranged on the quick latch segment, the V-shaped groove is stuck on the wedge-shaped surface for connection of the connection flange and the flange of the sealing head, the steel wire rope of the tightener passes through the locking hole of the quick latch segment, in this way, the metal furnace body is tightly fixed to the sealing head.

The crystal collector is connected to the vacuum tube of the crystal collector by a V-shaped rapid coupling, the lower end of the vacuum tube of the crystal collector is connected with the metal furnace body, wherein, the crystal collector includes a cooling-off sleeve, inside of the cooling-off sleeve is provided with a tapered crystallization sleeve, the cooling-off sleeve is respectively provided with a cool water inlet, a cool water outlet and a vacuum port, wherein the cool water inlet is connected to a water pump, the cool water outlet is connected to a water tank, the vacuum port is connected to a vacuum pump, a port of the cooling-off sleeve is sealed and covered with an end cover, the lower end of the cooling-off sleeve is provided with a flange of the cooling-off sleeve, the flange of the cooling-off sleeve is provided with a wedge-shaped surface and a V-shaped connector;

The upper end of the vacuum tube of the crystal collector is provided with a flange of a vacuum collection tube, the flange of a vacuum collection tube is provided with a wedge-shaped surface and a V-shaped connecting base, the V-shaped connector is connected with the V-shaped connecting base, an O-ring seal is arranged on the junction surface between the V-shaped connector and the V-shaped connecting bas, the flange of the cooling-off sleeve is tightly fixed to the flange of a vacuum collection tube by the V-shaped rapid coupling on the wedge-shaped surface thereof.

The suspension device comprises a double-arch portal structure consisting of two portal frames; each of the portal frame is respectively provided with a suspension lifting ear; both ends of the metal furnace body are respectively provided with two suspending points, wherein one of the two suspending points is suspended on one suspension lifting ear of the portal frame by steel wire rope, while the other suspending point is connected to the other suspension lifting ear by steel wire rope and an electric block.

The heat-transfer device of a heat storage body includes a heat storage body A, a reversal valve and a heat storage body B, the burners at both ends of the combustion chambers alternatively work via the heat storage body A, the reversal valve and the heat storage body B respectively. Each of burners on the two combustion chambers is respectively provided with a hot gas inlet and a hot gas outlet, both the heat storage body A and the heat storage body B are also respectively provided with a hot gas inlet and a hot gas outlet, the hot gas inlet and the hot gas outlet on a burner are connected to the reversal valve respectively through the hot gas inlets and the hot gas outlets of the heat storage body A and the heat storage body B.

The walking mechanism is suspended on the portal frame; the walking mechanism comprises an H-shaped steel; the H-shaped steel is sleeved with a U-shaped steel; a walking wheel is arranged on the U-shaped steel; the walking wheel strides across a lower beam of the H-shaped steel; a lifting ear connected with the electric block is arranged at the bottom of the U-shaped steel; and the lifting hook of the electric block is connected with the feeding mechanism through a steel rope of a hopper.

The feeding mechanism is provided with a hopper, the lower end of the hopper is provided with a discharge outlet; a bi-parting type discharge door is arranged on the discharge outlet; two ends of the bi-parting type discharge door are hinged on the discharge outlet; the bi-parting ends of the bi-parting type discharge door are connected together through the steel rope of the discharge door; and the steel rope of the discharge door is connected with the electric block through the steel rope of the hopper.

The loading inlet is provided with a cooling ring, the cooling ring is provided with a cooling water channel, a feeding door is arranged at the loading inlet, the feeding door is controlled by an electric actuator for opening or closing;

The discharge port is provided with a cooling ring, the cooling ring is provided with a cooling water channel, a discharge door is arranged at the discharge port, the discharge door is controlled by an electric actuator for opening or closing.

The metal furnace body is provided with a vibrator which drives the furnace body to vibrate.

A thermal insulation material layer is arranged in the metal furnace body.

A gas burner or an oil burner can be used for the furnace.

The invention has the following advantages: the furnace which is mechanized and intelligentized can control key points of each condition through a PLC programming, and provide CRT display and surveillance monitoring. Compared with a conventional furnace equipped with 50 stainless steel reduction tanks (consumption of reduction furnace as much as 35 T), by adopting the patented technology, on the condition of identical or even excess production capacity, we can save 90% of stainless steel reduction furnaces, reduce ⅔ labor, save 60% of energy consumption (oil, coal and gas), and increase by 2-3 times of the reduction cycle (about 4 hours reduction cycle compared with the original 12-hours reduction cycle), thoroughly changing the conventional method of external heating from a split-type furnace for extracting magnesium and a reduction tank, solving the problem of low thermal efficiency, low production efficiency, no automation, no mechanization, high labor intensity, harsh environment and other aspects of backwardness of the conventional reduction furnace, and achieving mechanization, automation, energy saving, high production efficiency and easy maintenance effects of a process of extracting magnesium by a thermal method.

The furnace adopts a metal furnace body, realizes industrial mass production and assembly, and thoroughly changes the conventional bricked earth furnace structure, thus being used more widely, available for being used as a metal reduction furnace, a water boiler and a steam boiler etc.

In the Figs,

1: Base;
2: Right Flue Gas Chamber;
3: Burner;
31: Igniter;
32: Fuel Inlet;
33: Hot Flue-Gas Inlet;
34: Hot Flue-Gas Outlet;
35: Burner Flange;
36: Flame Nozzle;
38: Hand Tightener;
4: Seal Cartridge;
41: Suspending Point;
42: Expansion Joint;
5: Sealing Head;
51: Cool Water Outlet;
52: Flange Of Sealing Head;
53: Fixed Mount of the Discharge Door;
54: Discharge Door;
55: Electric Actuator;
56: Articulated Shaft;
57: O-Ring Seal;
58: Fixed Mount of the Feeding Door;
59: Feeding Door;
6: Quick Locker;
7: Steel Wire Rope;
8: Crystal Collector;
81: Cooling-off Sleeve;
82: Crystallization Sleeve;
83: Upper Flange of the Cooling-off Sleeve;
84: End Cover;
85: Vacuum Tube of the Crystal Collector;
86: Primary Connection for Vacuum Pump and Solenoid Valve;
87: Flange of the Cooling-off Sleeve;
88: Flange of the Vacuum Collection Tube;
9: Loading Mechanism;
91: Hopper;
92: Hopper Discharge Outlet;
93: Bi-parting Type Discharge Door;
94: Steel Rope of the Discharge Door;
95: Hanging Ring;
10: Electric Block;
11: Loading Inlet;
12: Cooling Ring;
13: Cooling Water Channel;
14: Flue Gas Heat Radiation Pipe;
15: Discharge Port;
16: Rail;
17: Slag-Conveying Wagon;
18: Left Combustion Chamber;
19: Right Combustion Chamber;
20: Walking Mechanism;
21: H-Shaped Steel;
22: Walking Wheel;
23: U-Shaped Steel;
24: Lower Beam;
25: Lifting Ear;
26: V-Shaped Connector;
27: V-Shaped Connecting Base;
28: Hot Flue Gas Hole;
30: Feeding Door Mechanism;
40: Metal Furnace Body;
47: Cool Water Inlet;
48: Wedge-shaped Surface;
49: Connection Flange;
50: Portal Frame;
60: Left Flue Gas Chamber;
61: Quick Latch Segment;
62: Locking Hole;
63: V-shaped Groove;
70: Discharge Door Mechanism;
71: Vacuum Port;
72: Cool Water Inlet;
73: Cool Water Outlet;
80: vibrator;
841: Bolt Hole;
100: Middle Flue Gas Chamber;
101: Solenoid Valve;
102: Heat-Storage Body A;
103: Blowing Engine;
104: Reversal Valve;
105: Draught Fan;
106: Flue Gas Exhaust Pipe;
107: Heat-Storage Body B.

DETAILED DESCRIPTION OF THE EMBODIMENTS

Figure 1:
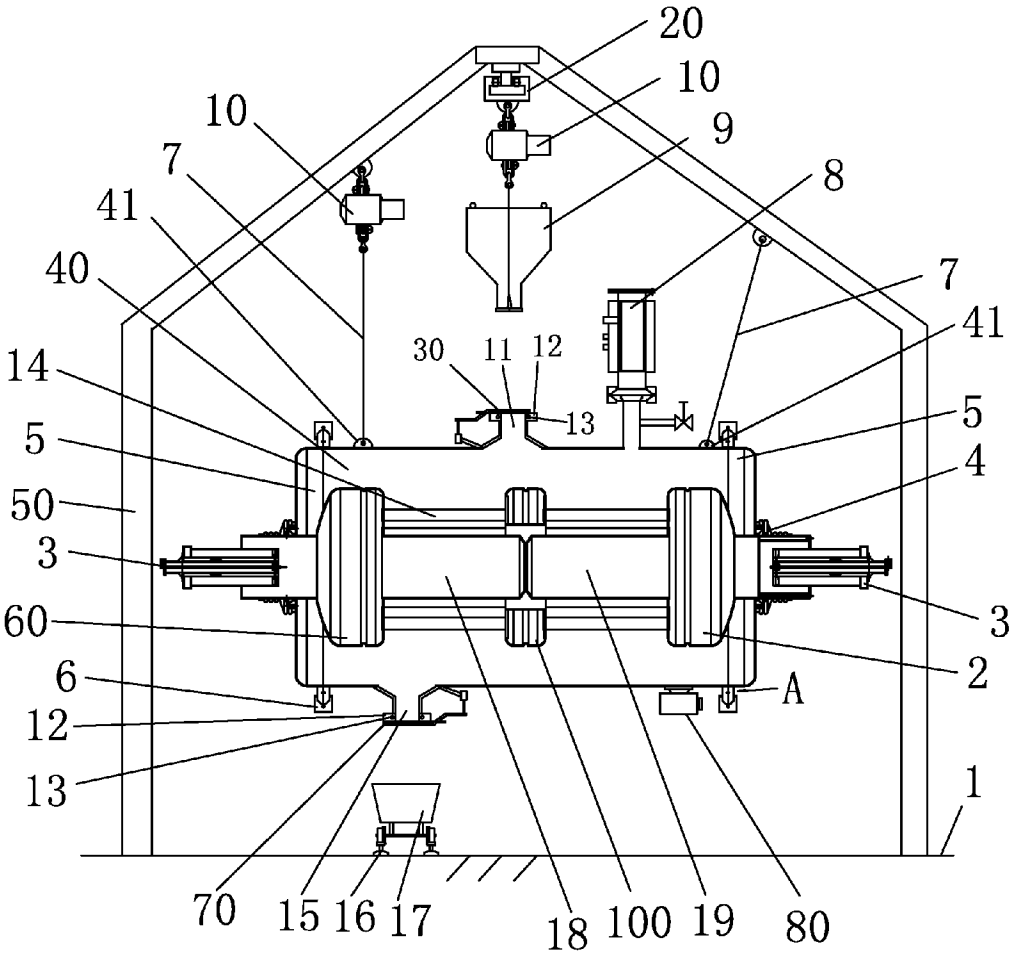
FIG. 1 is an overall structure diagram of the invention.
Figure 2:
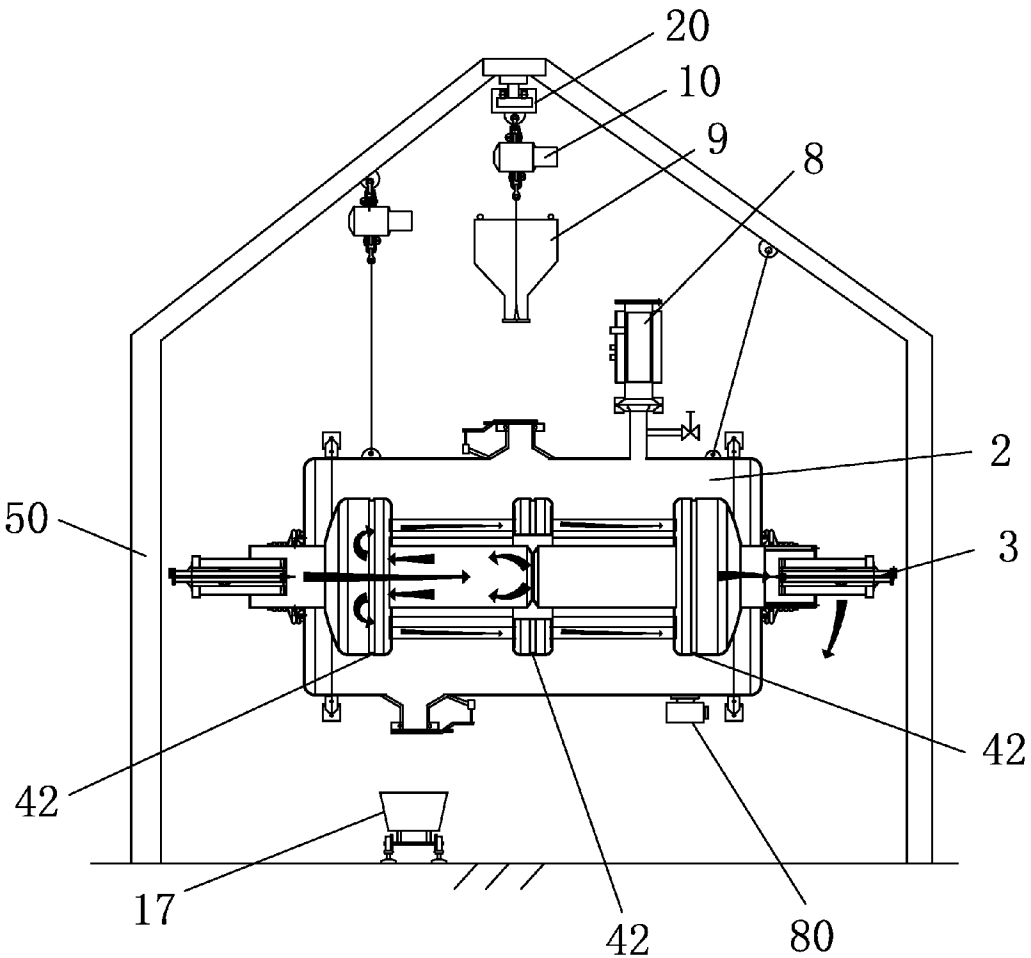
FIGS. 2-3 are schematic views for showing flow of hot flue gas in the combustion chambers as shown in FIG. 1.
Figure 3:
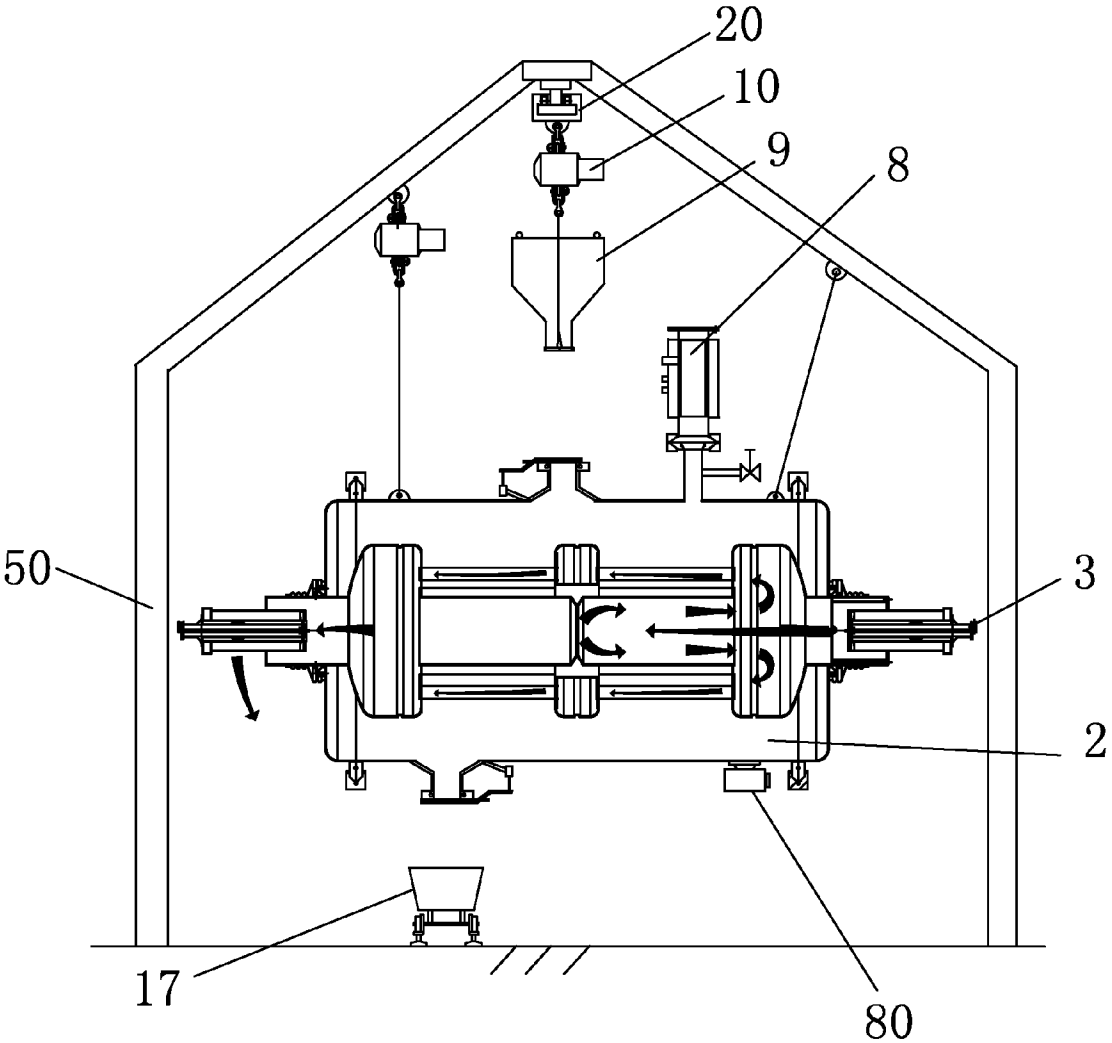
Figure 4:
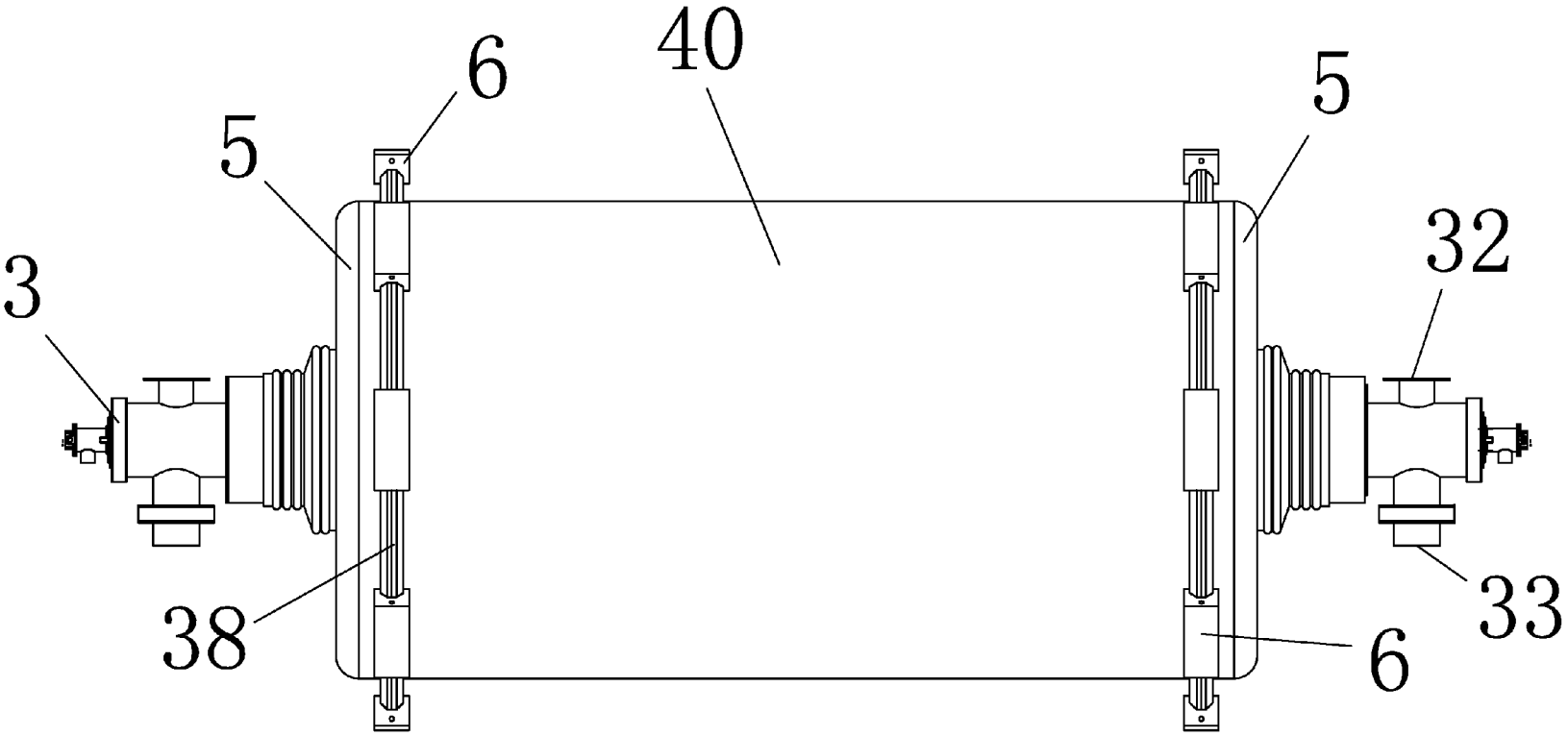
FIG. 4 is a schematic view of the metal furnace body as shown in FIG. 1.

Further description of the utility model is made in conjunction with the accompanying drawings:

As shown in FIGS. 1-3, the furnace consists of a suspension device, a metal furnace body 40, a left and a right sealing heads 5, a burner 3, a magnesium crystal collector 8, a loading mechanism 9, a walking mechanism 20, a feeding door mechanism 30, a discharge door mechanism 70, a heat-transfer device of a heat storage body, a quick locker 6, a vibrator 80 etc. The metal furnace body 40 is suspended horizontally on the suspension device.

The suspension device, mainly used for suspending the metal furnace body 40, is provided with the walking mechanism 20 and the loading mechanism 9, including a double-arch portal structure consisting of two portal frames 50; botch the portal frames 50 are fixed on the base 1, suspending points 41 at both ends of the whole metal furnace body 40 are suspended on the suspension lifting ear of the portal frame 50 by a steel wire rope 7, wherein one of the two suspending points 41 is suspended on the suspension lifting ear of the portal frame 50 by the steel wire rope 7 and an electric block 10, this end can move upward and downward via the electric block 10, raw material is provided by loading mechanism 9, and there is a slag-conveying wagon 17 underneath used for carrying slags away.

As shown in FIGS. 4-7, both ends of the metal furnace body 40 are respectively connected to the sealing head 5, wherein both ends of the furnace body 40 of the reduction furnace are respectively connected with a connection flange 49, the connection flange 49 is provided with a wedge-shaped surface 48, the sealing head 5 is provided with a flange 52 of the sealing head, the flange 52 of the sealing head is provided with the wedge-shaped surface 48, a cooling water channel 13 is arranged on the junction surface between the connection flange 49 and the flange 52 of the sealing head, the connection flange 49 and the flange 52 of the sealing head are respectively provided with a cool water inlet 47 and a cool water outlet 51 which are communicated with the cooling water channel 13; after the metal furnace body 40 is docked to the sealing head 5, the quick locker 6 is fixed on the wedge-shaped surface 48. Inside of the metal furnace body 40 is provided with a furnace chamber which is separated and divided at the middle into two separate furnace chambers, namely a left combustion chamber 18 and a right combustion chamber 19. The left combustion chamber 18 and the right combustion chamber 19 are respectively connected with the burner 3, also the left combustion chamber 18 and the right combustion chamber 19 are respectively connected with a flue gas chamber 2 and a flue gas chamber 60, both the flue gas chamber 2 and the flue gas chamber 60 are fixed in the sealing head 5 by a bushing, a seal cartridge 4 is arranged between the bushing of the sealing head and the flue gas chambers (2, 60), ends of the flue gas chambers (2, 60) are provided with the burner 3, on the flue gas chambers (2, 60) is provided with a flue gas hole (not drawn in the drawing), in the middle position (between the two separate furnace chambers) of the excircle of the furnace chamber is provided with a middle flue gas chamber 100, on the periphery (the periphery of the furnace chamber) of the left and the right combustion chambers (18,19) is provided with multiturn flue gas heat radiation pipes 14, one end of the flue gas heat radiation pipe 14 is connected to the middle flue gas chamber 100, while the other end of the flue gas heat radiation pipe 14 is respectively connected to the flue gas chambers (2, 60), the two independent combustion chambers (18, 19) are communicated with each other through the flue gas chambers (2, 60), the flue gas heat radiation pipes 14 and the middle flue gas chamber 100, and combust alternately. For example, when the combustion chamber 18 combusts, the combustion chamber 19 stops combusting. Hot flue gas produced by the combustion chamber 18 is sucked into the heat-transfer device of a heat storage body through the flue gas chamber 60, the flue gas heat radiation pipe 14, the middle flue gas chamber 100, the flue gas heat radiation pipe 14, the flue gas chamber 2 and the burner 3 of the combustion chamber 19, vise versa. On the metal furnace body 40 is provided with a loading inlet 11 and a magnesium crystal collector 8, under the metal furnace body 40 is provided with a discharge port 15, the space between the metal furnace body 40 and the combustion chambers (18, 19) is a loading chamber, and on the surface of the metal furnace body 40 is provided with a suspending point 41. Inside of the metal furnace body 40 is provided with a thermal insulation material layer and a thermal-protective coating (not drawn in the drawing). On the metal furnace body 40 is provided with a vibrator 80 used for vibrating the metal furnace body 40 so as to ensure more raw feeds are loaded into the furnace, and are heated more evenly and fully.

Figure 7:
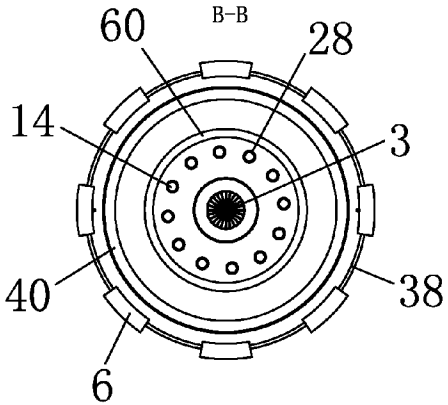
FIG. 7 is a B-B section view of FIG. 6.
Figure 6:
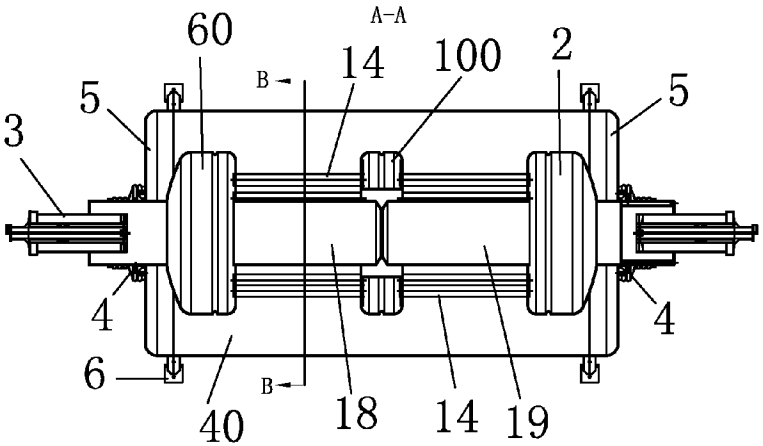
FIG. 6 is an A-A section view of FIG. 5.
Figure 5:
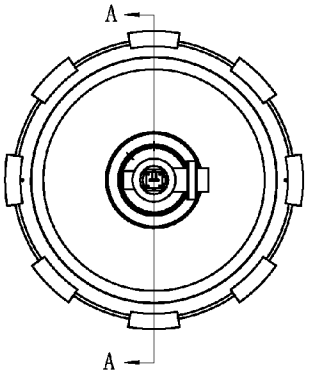
FIG. 5 is a side view of FIG. 4.
Figure 8:
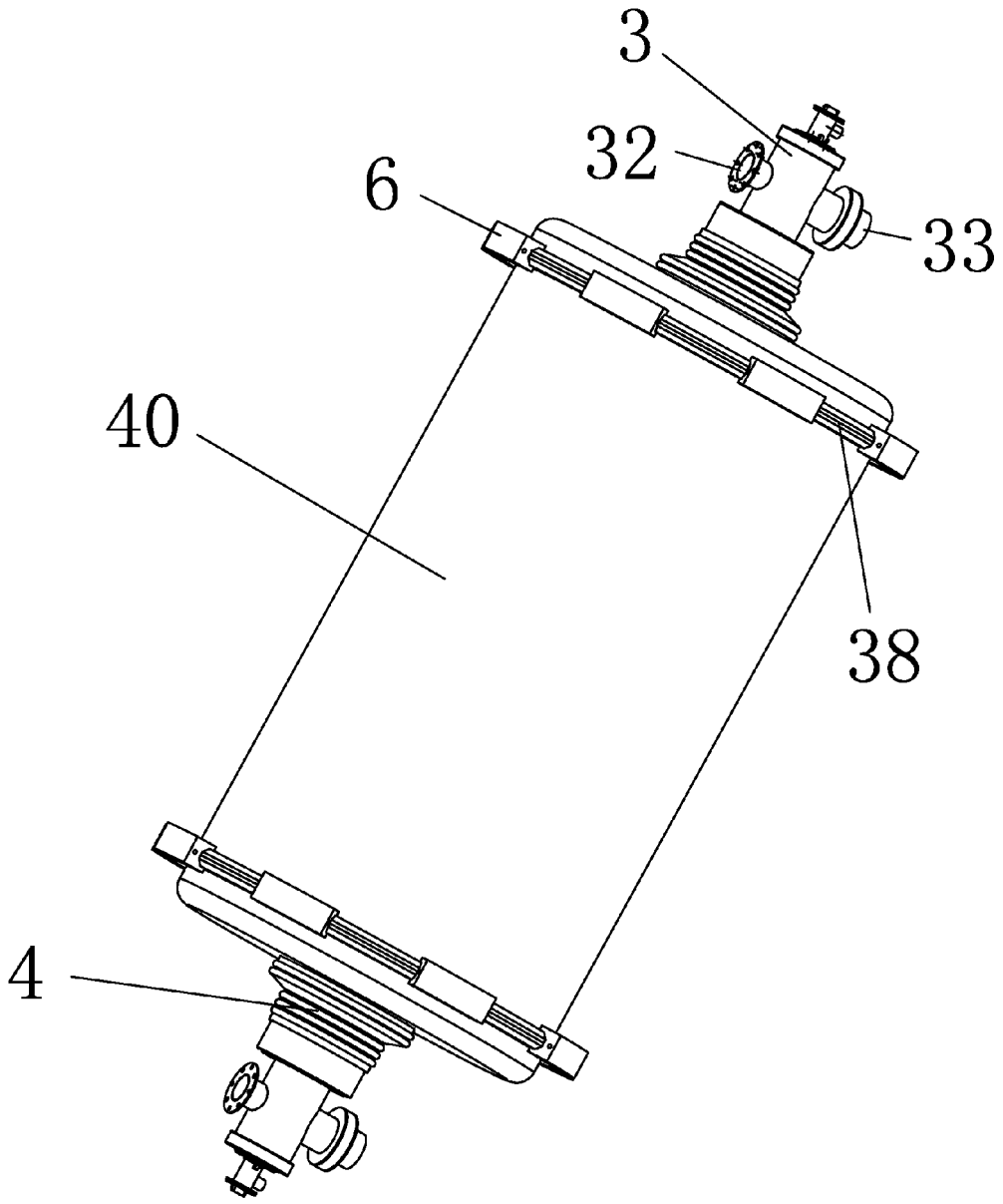
FIG. 8 is a space diagram of FIG. 4.

As shown in FIG. 7, the flue gas chamber 2 and the flue gas chamber 60 are used for flue gas reversing, and are respectively docked to the combustion chamber 18 and the combustion chamber 19, one their end surface is provided with multiturn holes 28 used for welding the flue gas heat radiation pipes 14.

As shown in FIG. 1, the middle flue gas chamber 100 is butt welded by two flat surface end cover tube sheets, and is fixed on the middle position of the excircle of the furnace chamber, its end surface is provided with multiturn holes 28 used for connecting the flue gas heat radiation pipes 14.

Figure 9:
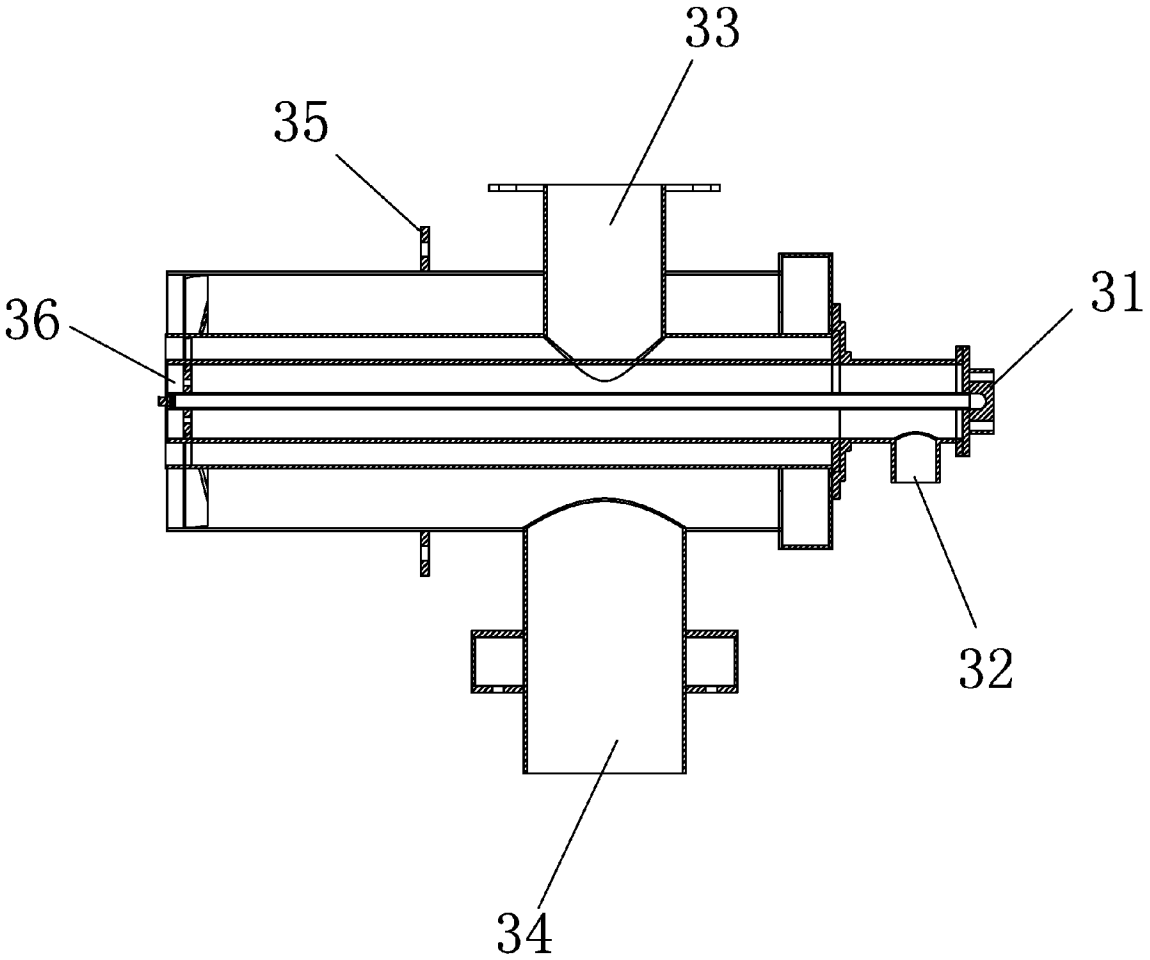
FIG. 9 is a schematic view of the burner as shown in FIG. 1.

As shown in FIG. 9, the burner 3 consists of an igniter 31, a fuel inlet 32, a hot gas inlet 33, a hot gas outlet 34, a burner flange 35 and a flame nozzle 36; the hot gas inlet 33 and the hot gas outlet 34 of the burner 3 are respectively connected with the heat storage body 102 of the heat-transfer device of a heat storage body and the hot gas inlet and the hot gas outlet of the heat storage body 107.

Figure 23:
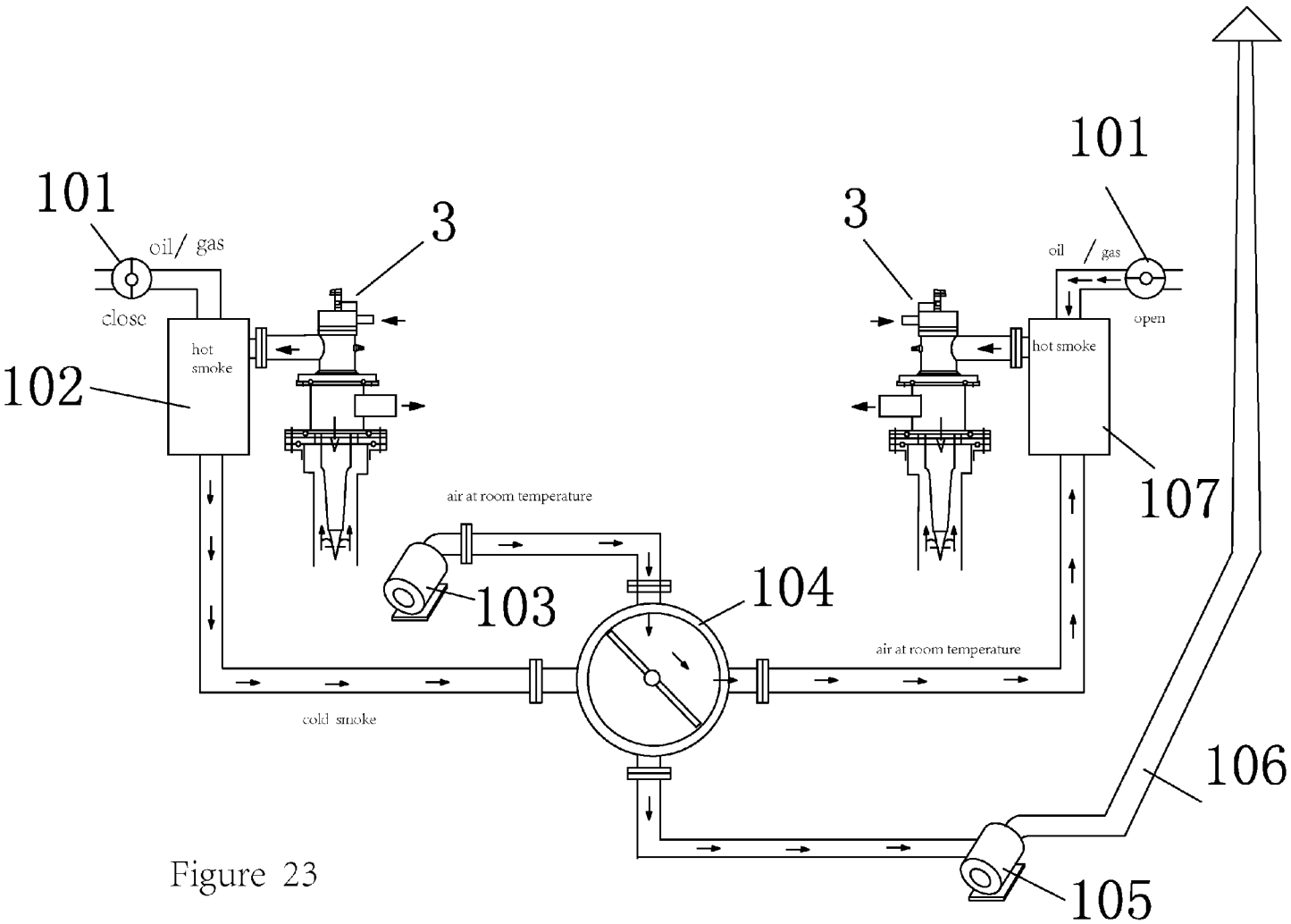
FIG. 23 is a schematic view of the heat-transfer device of a heat storage body in the invention.

As shown in FIG. 23, the heat-transfer device of a heat storage body consists of a solenoid valve 101, a heat storage body A (102), a blowing engine 103, a reversal valve 104, an draught fan 105, a flue gas exhaust pipe 106 and a heat storage body B (107); one of the two burners 3 is connected to the heat storage body A, the other one is connected to the heat storage body B; hot flue gas produced by the metal furnace body 40 respectively enters into the heat storage body A and the heat storage body B through the hot gas outlet 34 of the burner 3, and, under the effect of the reversal valve 104, enters into the other combustion chamber of the metal furnace body 40 through the hot gas inlet 33 of the burner, and so on alternately, thus playing a role in preheating, combustion supporting and energy saving.

Figure 10:
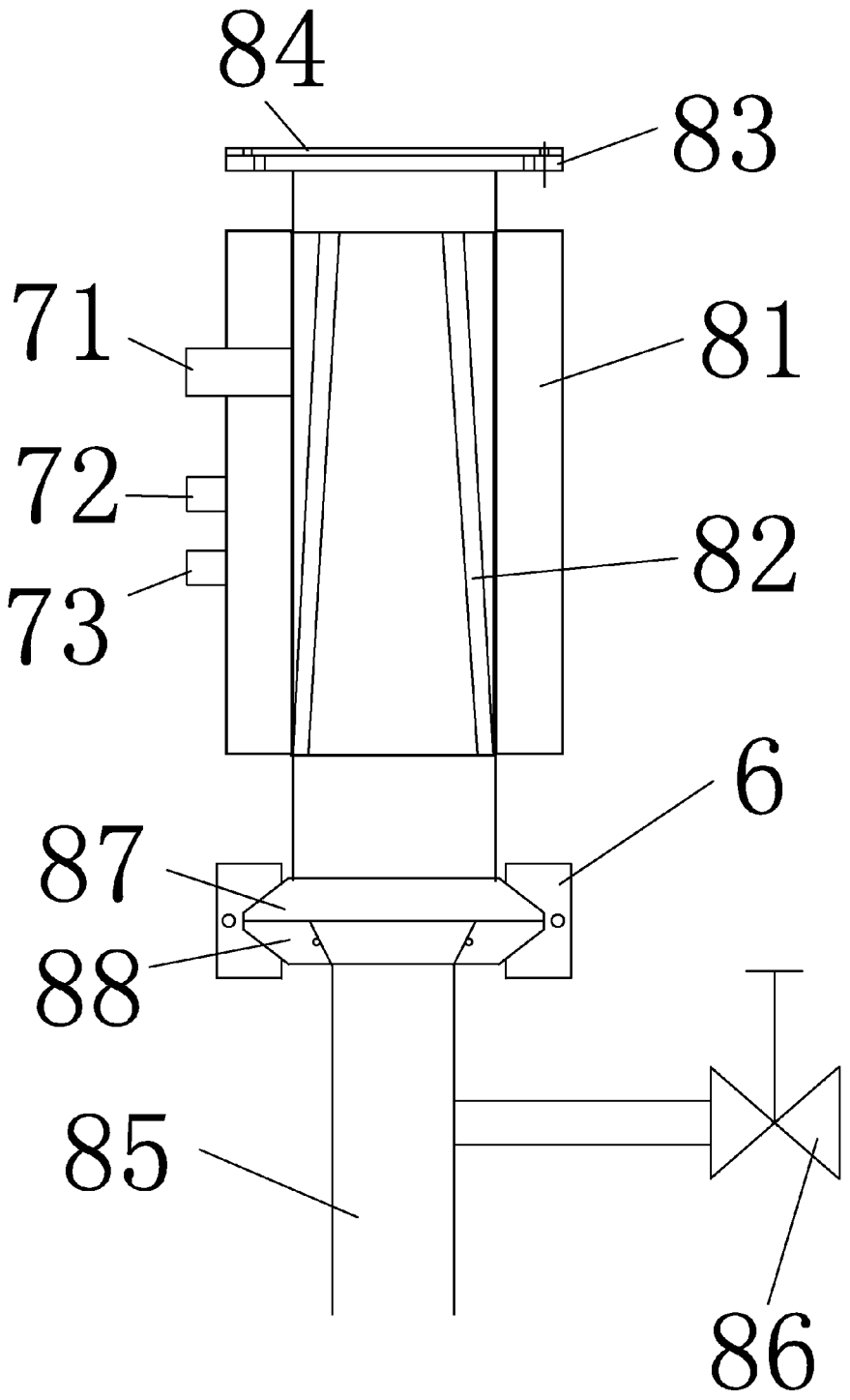
FIG. 10 is a schematic view of the crystal collector as shown in FIG. 1.
Figure 11:
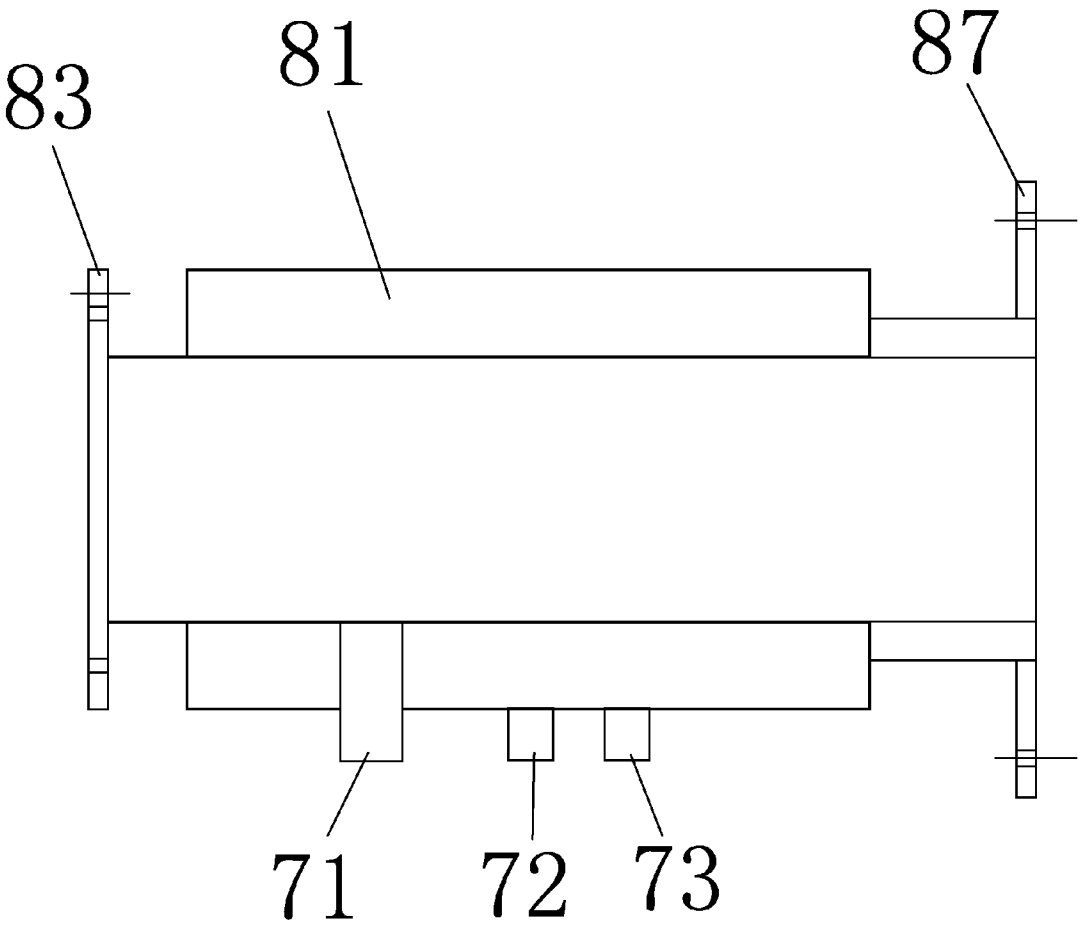
FIG. 11 is a schematic view of the cooling-off sleeve as shown in FIG. 10.
Figure 12:
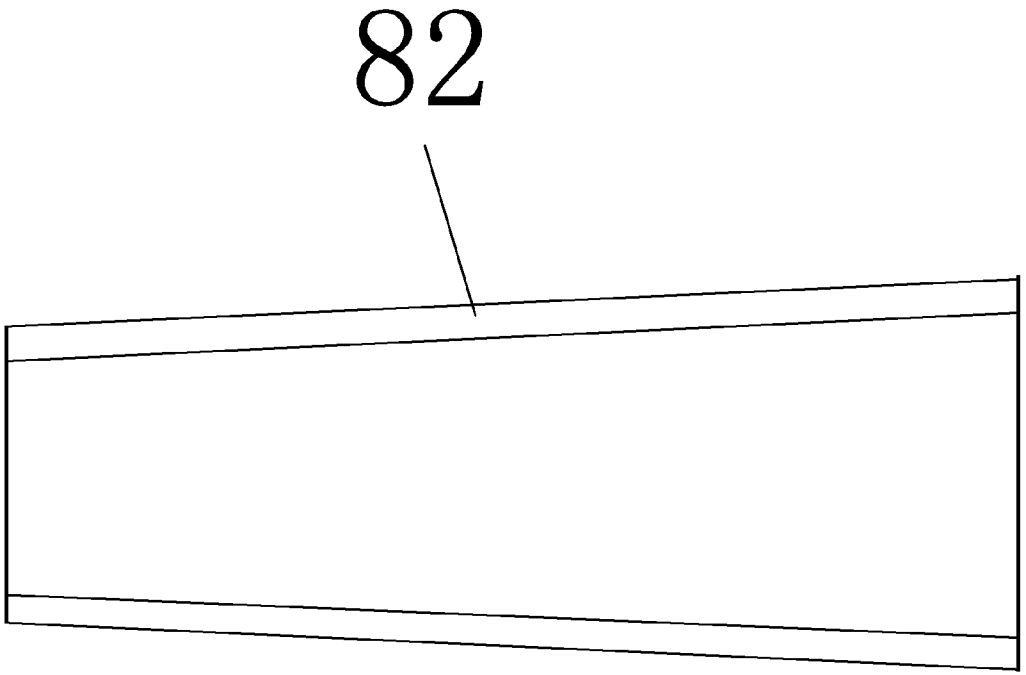
FIG. 12 is a schematic view of the crystallization sleeve as shown in FIG. 10.
Figure 13:
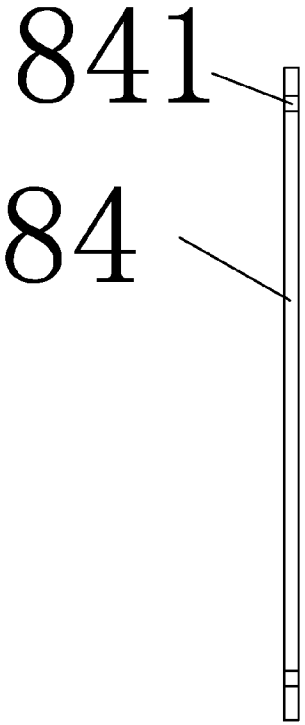
FIG. 13 is a schematic view of the seal cover as shown in FIG. 10.
Figure 14:
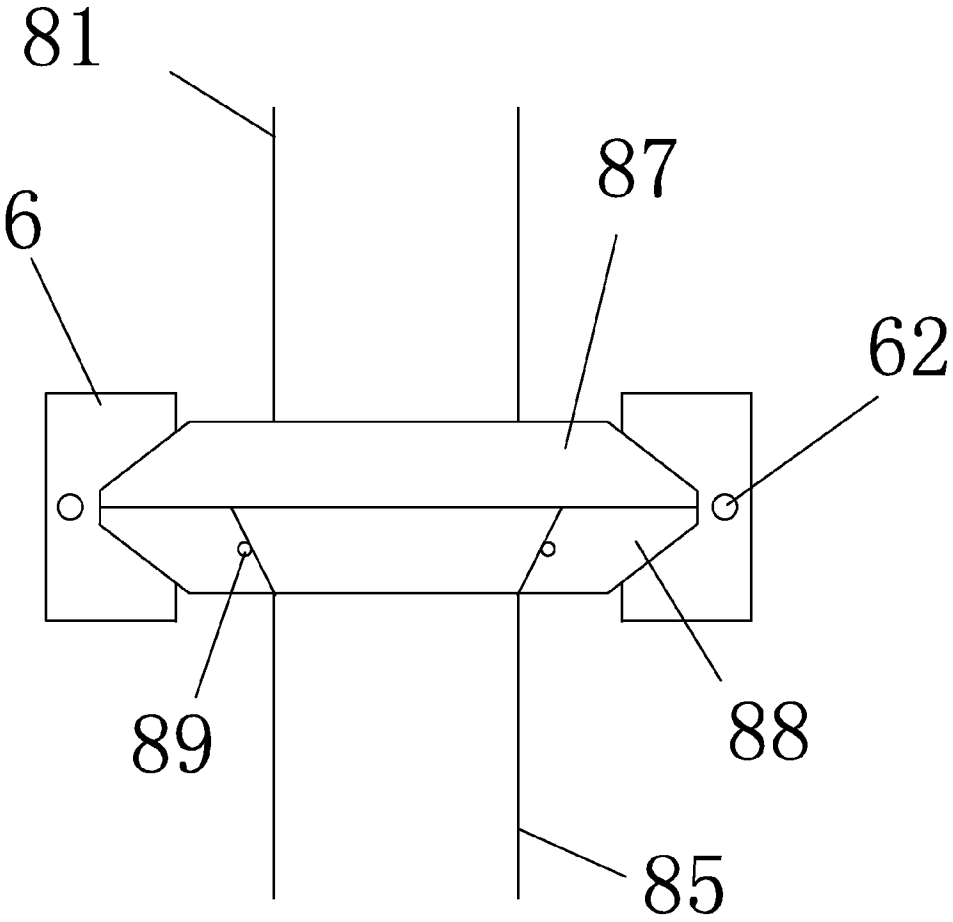
FIG. 14 is a schematic view of the quick locker as shown in FIG. 10.

As shown in FIG. 10, the lower end of the crystal collector 8 is connected to the vacuum tube 85 of the crystal collector by a V-shaped rapid coupling, the lower end of the vacuum tube 85 of the crystal collector is connected with the metal furnace body 40. The crystal collector 8 comprises a cooling-off sleeve 81, inside of the cooling-off sleeve 81 is provided with a cone crystallization sleeve 82, on the cooling-off sleeve 81 is provided with cool water inlet 72, a cool water outlet 73 and a vacuum port 71; wherein the cool water inlet 72 is connected with a water pump, the cool water outlet 73 is connected with a water tank, and the vacuum port 71 is connected with a vacuum pump; on the port of the cooling-off sleeve 81 is sealed and covered with an end cover 84, the lower end of the cooling-off sleeve 81 is provided with a flange 87 of the cooling-off sleeve, the flange 87 of the cooling-off sleeve is provided with a wedge-shaped surface 48 and a V-shaped connector 26; on the upper end of the vacuum tube 85 of the crystal collector is provided with a flange 88 of the vacuum collection tube; the flange 88 of the vacuum collection tube is provided with the wedge-shaped surface 48 and a V-shaped connecting base 27; the V-shaped connector 26 is inserted and connected to the V-shaped connecting base 27; on the connection surface between the V-shaped connector 26 and the V-shaped connecting base 27 is provided with an O-ring seal 89, after the lower end of the cooling-off sleeve 81 is docked to the upper end of the vacuum tube 85 of the crystal collector, the cooling-off sleeve is tightly fixed to the flange of a vacuum collection tube by the V-shaped rapid coupling on the wedge-shaped surface 48.

Figure 15:
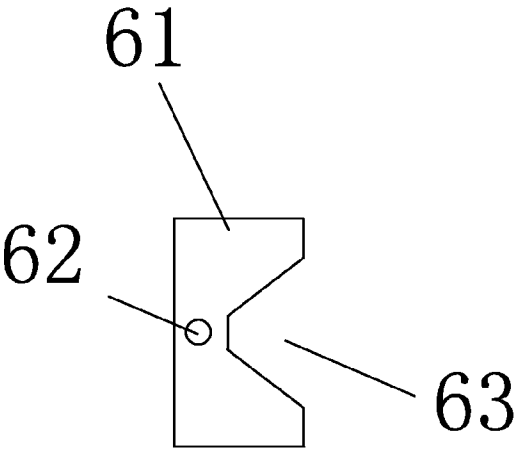
FIG. 15 is a schematic view of the quick latch segment as shown in FIG. 14.
Figure 16:
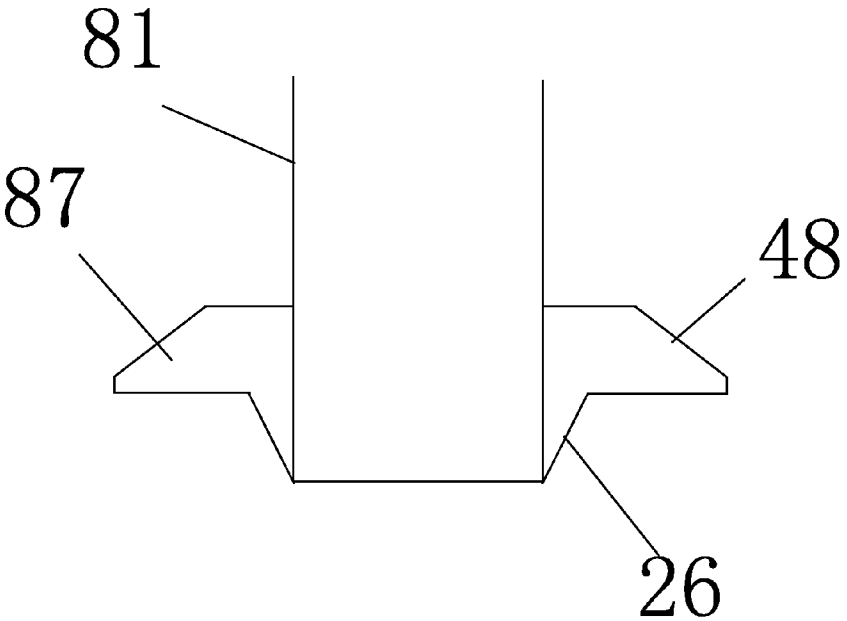
FIG. 16 is a schematic view of the upper locking flange as shown in FIG. 14.
Figure 17:
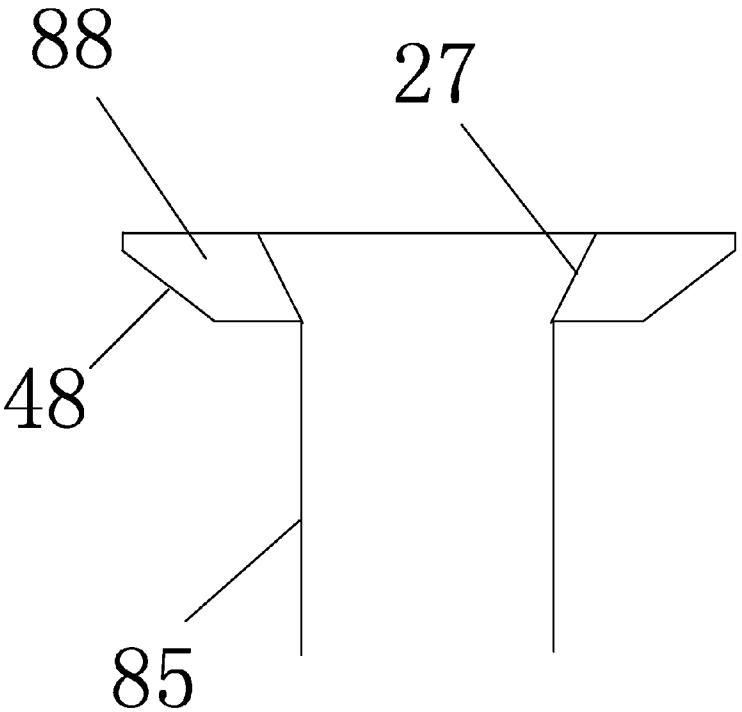
FIG. 17 is a schematic view of the lower locking flange as shown in FIG. 14.

As shown in FIG. 15, the quick locker 6 is provided with a quick latch segment 61; a V-shaped groove 63 and a locking hole 62 are arranged on the quick latch segment 61, the V-shaped groove 63 is stuck on the wedge-shaped surface 48, the steel wire rope of the hand tightener 38 passes through the locking hole 62 of the quick latch segment, in this way, the flange of the wedge-shaped surface 48 is tightly fixed.

Figure 18:
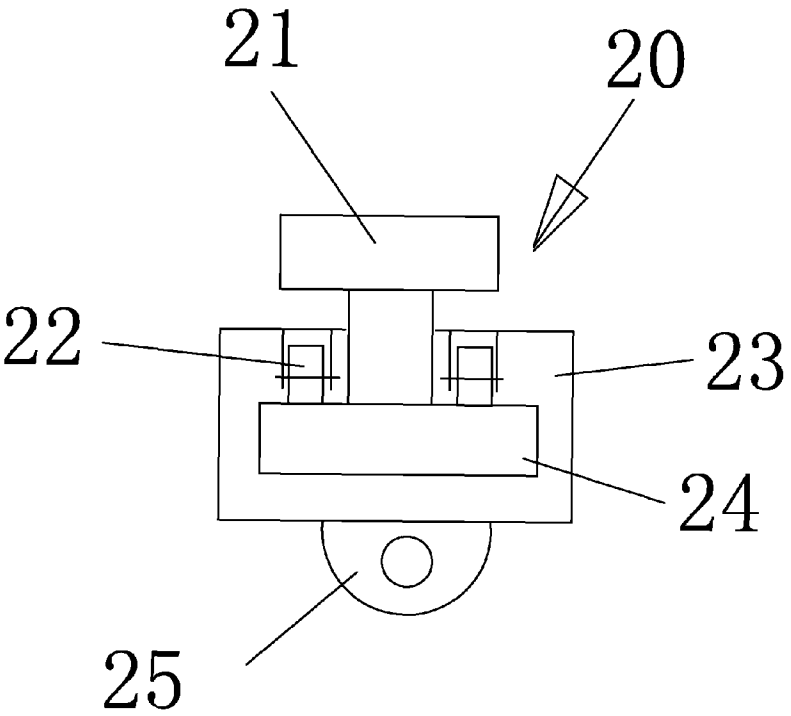
FIG. 18 is a schematic view of the walking mechanism as shown in FIG. 1.

As shown in FIG. 18, the walking mechanism consists of an H-shaped steel 21, two walking wheels 22, a U-shaped steel 23, a lower beam 24, a lifting ear 25, and an electric block 10; wherein, the H-shaped steel 21 is sleeved with the U-shaped steel 23; two walking wheels 22 are arranged on the U-shaped steel 23; the walking wheels 22 stride across the lower beam 24 of the H-shaped steel 21; the lifting ear 25 which is connected to the electric block 10 is arranged at the bottom of the U-shaped steel 23; the U-shaped steel 23 walks on the H-shaped steel 21, and the electric block 10 is connected to a feeding mechanism 9 through a steel wire rope.

Figure 19:
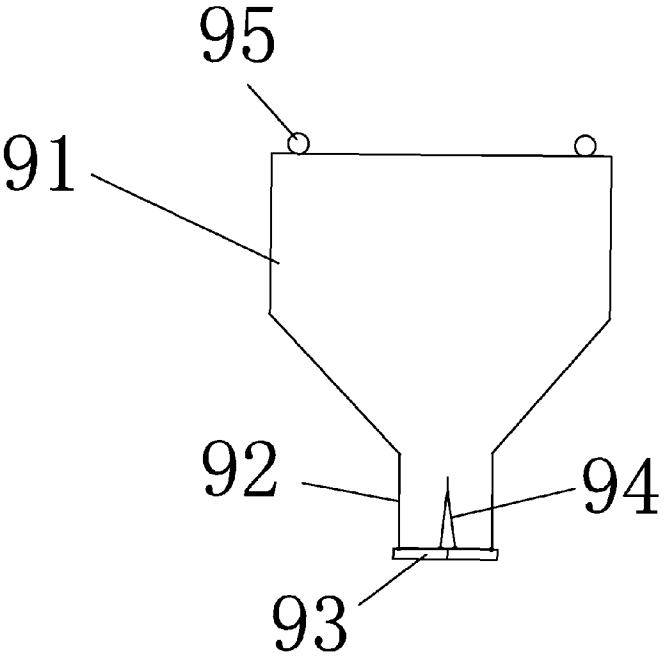
FIG. 19 is a schematic view of the feeding mechanism as shown in FIG. 1.

As shown in FIG. 19, the feeding mechanism 9 consists of a hopper 91, a hopper discharge outlet 92, a bi-parting type discharge door 93, a steel rope 94 of the discharge door, and a hanging ring 95; wherein the lower end of the hopper 91 is provided with the hopper discharge outlet 92 on which the bi-parting type discharge door 93 is arranged; two ends of the bi-parting type discharge door 93 are hinged on the discharge outlet 92; the bi-parting ends of the bi-parting type discharge door 93 are connected together through the steel rope 94 of the discharge door; and the steel rope 94 of the discharge door is connected with the electric block 10 through the steel rope. The discharge door 93 is closed when the steel wire rope is pulled up; and the discharge door 93 is automatically opened under the action of weight of feeds when the steel wire rope is relaxed, so the feeds flows into the furnace body 40 of the reduction furnace.

Figure 20:
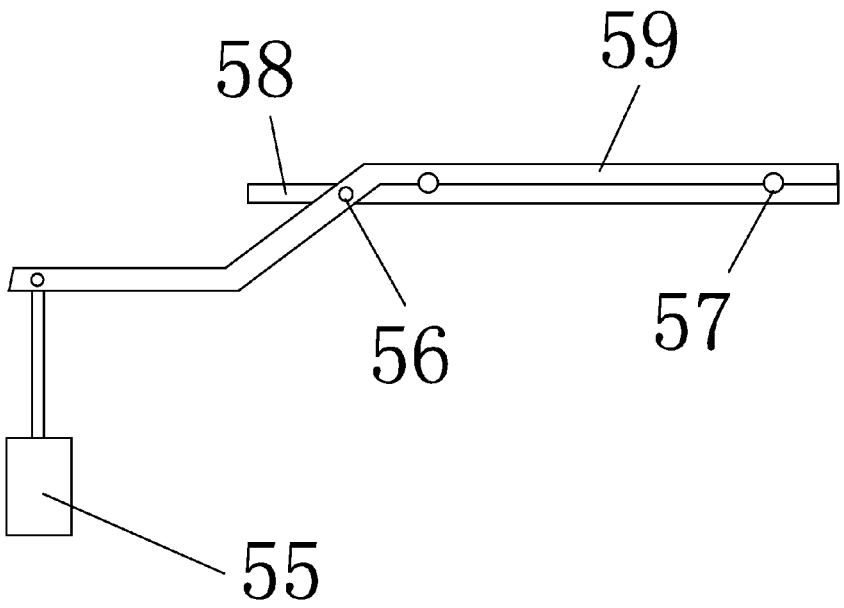
FIG. 20 is a schematic view of the feeding door as shown in FIG. 1.

As shown in FIG. 20, the loading inlet 11 is provided with a feeding door mechanism 30; the feeding door mechanism 30 consists of a feeding door 59, a fixed mount 58 of the feeding door, and an electric actuator 55; the fixed mount 58 of the feeding door is fixed on the loading inlet 11, the feeding door 59 is articulated with the fixed mount 58 of the feeding door through an articulated shaft 56, the electric actuator 55 is connected to the rear end of the feeding door 59; driven by the electric actuator 55, the feeding door 59 turns by taking the articulated shaft 56 as the center of a circle, so as to open or close the loading inlet 11; an O-ring seal 57 is arranged between the feeding door 59 and the fixed mount 58 of the feeding door.

Figure 21:
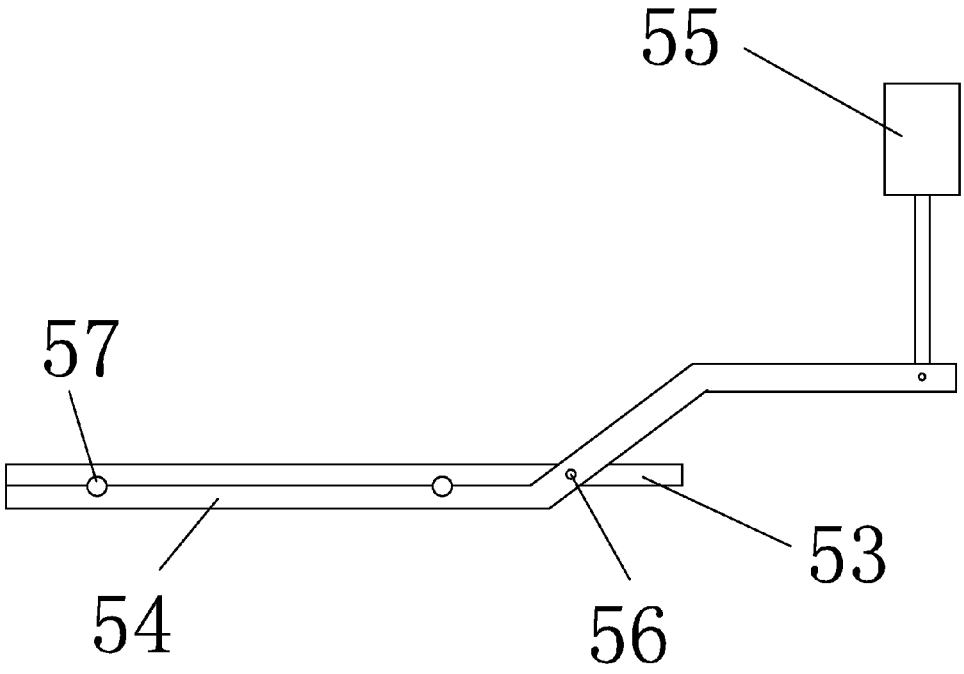
FIG. 21 is a schematic view of the discharge door mechanism as shown in FIG. 1.
Figure 22:
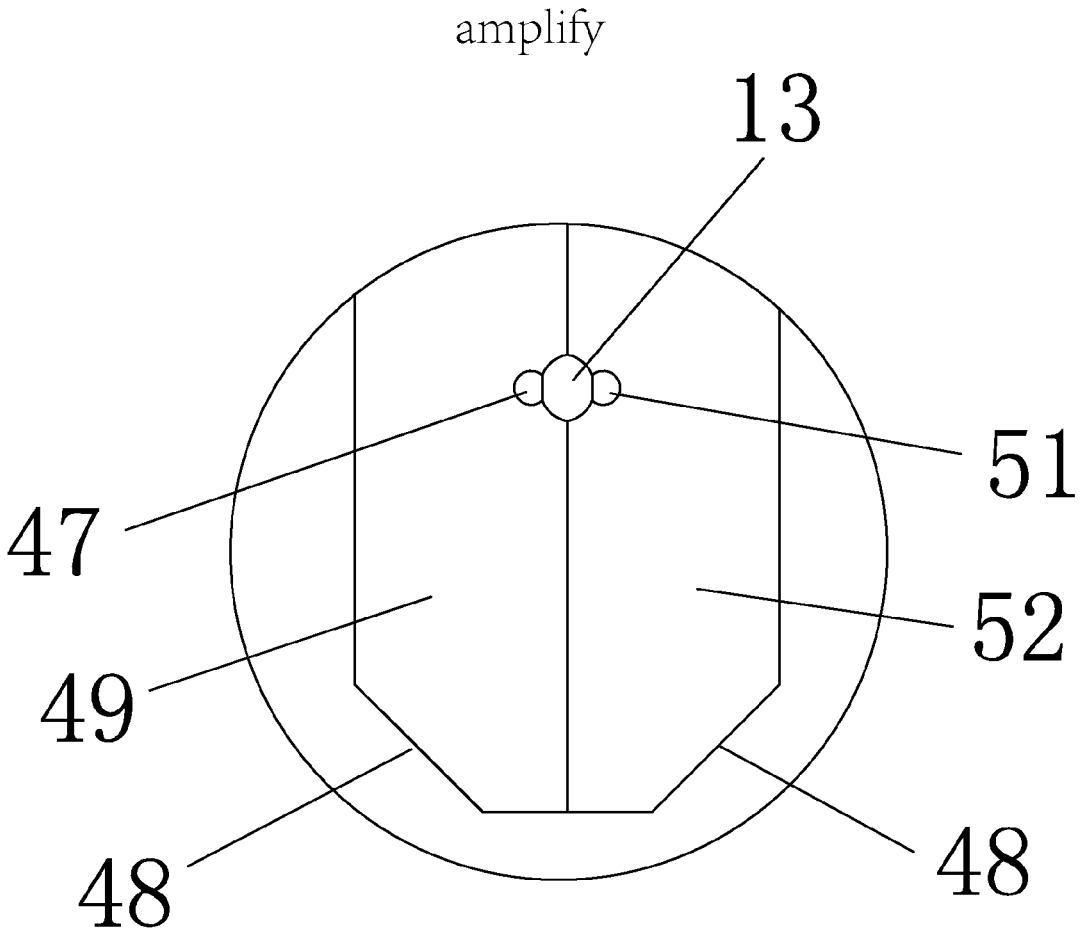
FIG. 22 is an enlarged view along Direction A of FIG. 1.

As shown in FIG. 21, the discharge port 15 is provided with a discharge door mechanism 70 whose structure and working principle is the same as the feeding door mechanism 30.

Figure 24:
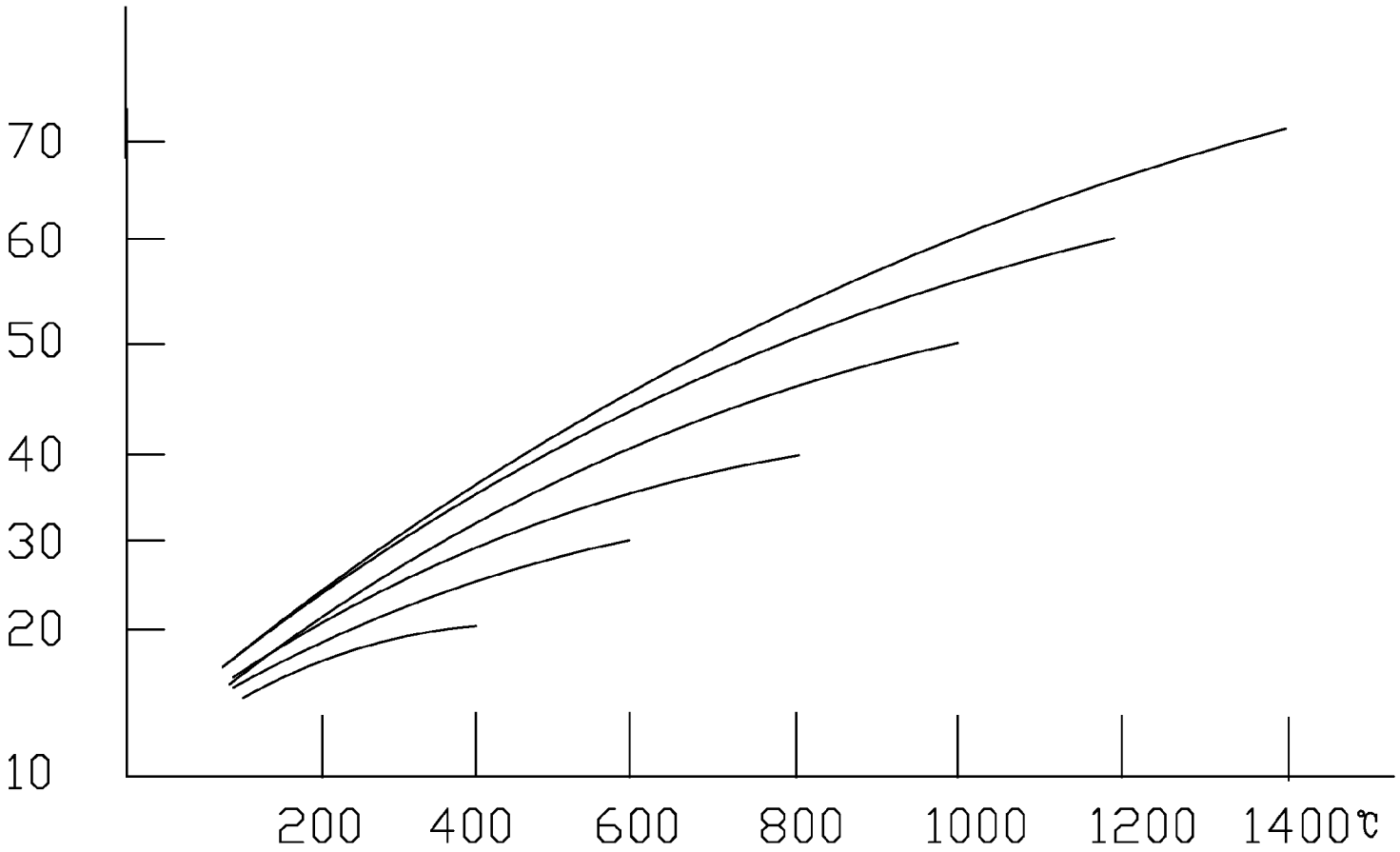
FIG. 24 is a curve chart regarding the ratio between heat-storage preheating combustion air and fuel saving.

FIG. 24 shows the chart of ratio relation between heat-storage preheating combustion air and fuel saving in the invention, in which, FIG. 10-70 indicates energy saving rate (%) in combustion, FIG. 200-1400 indicates the temperature (° C.) of the heat-storage preheating combustion air, the curve in the Fig. indicates the temperature curve of flue gas exhausted.

Working Principle:

The invention is adaptable for the requirements of constant temperature and heating within a heating temperature section required by each process under the temperature of 1200° C., magnesium produced by a thermal method, the heating, drying, thermally stimulating and thermally decomposing other metal material, atmospheric pressure or negative pressure adsorption type of 0.013/kpa according to the process requirements, and refining and thermal decomposition of magnesium metal and other adsorption type reduction process needing the negative pressure under the temperature of 1200° C. The furnace adopts a coaxial segmented heat-storage preheating combustion type. The furnace body is separated from its middle and divided into two independent furnace chambers (two combustion chambers), which are heated by burners.

The furnace adopts the type of heating by burners and heat storage bodies through heat absorption and heat release. Burners combusts alternately, thus facilitating the feeds in the furnace to be heated and become hot rapidly. The feeds in the furnace are uniformly heated through highly efficiently and rationally using heat, convection and conduction.

As to the invention, a burner is equipped for burning the furnace chamber (combustion chamber), thus carrying out inside-out radiation, conduction, convection and heating. At the same time, auxiliary combustion with externally heating, heat storage, and the recycling, preheating and combustion air are provided, thus controlling and achieving high-temperature combustion with low excess air coefficient and hence achieving the best combustion heating effects.

The combustible gas or fuel oil, through a burner, is mixed in advance and injected into the combustion chamber to be burned, and radiates high-temperature heat peripherad. The high-temperature flue gas produced after combustion passes through the heat-storage body and enters the burner to be recycled and used. The combustible air and gas are pre-heated and heated from the room temperature to 800-1000° C. After the heat of the burned exhaust gas is exchanged in a heat-storage body, it becomes the flue gas under the temperature equal to or less than 150° C. and is discharged (the discharge and combustion temperature of the traditional old-fashioned furnace reaches 1000-1100° C.). See FIG. 24: The Relation Table of Preheated Air Temperature and Combustion Saving Rate.

The furnace is arranged horizontally in a suspension type and can be adjusted obliquely for discharging. The furnace body part is a split-type structure and consists of a furnace body and a sealing head; two independent combustion chambers (furnace chambers) are horizontally arranged in the furnace body, burning alternately; in the furnace body is also provided with a flue gas chamber communicated with the combustion chambers, used for exchanging heat; on the periphery of the flue gas chamber is provided with multiturn flue gas heat radiation pipes communicated with the flue gas chamber; the two combustion chambers are separated and connected to the burner through the flue gas chamber and the flue gas heat radiation pipes.

Such a structure facilitates heating elements in the inner part to be installed and disassembled conveniently. After The furnace body is laid down and the flange tightener is loosed, broken parts can be replaced or repaired. Therefore, the furnace part is facilitated not to be scrapped and may be continuously used. The furnace is also characterized in that cooling structures are arranged, thus prolonging the service life of equipment.

The working principle of the heat-storage type burner is as follows (as shown in FIG. 9): After the air at normal temperature discharged from a blowing engine is exchanged by a reversal valve and enters a heat-storage burner B, it is heated when it is passed through the heat-storage type burner B (a ceramic ball or a cellular body). In a very short period of time, the air at the normal temperature is heated to a temperature close to the furnace temperature (it is generally by 50-100° C. lower than the furnace temperature). After the heated high-temperature air enters the furnace, the flue gas in the furnace is entrained and forms a rarefied oxygen-poor high-temperature air with oxygen content which is significantly below 21%. At the same time, the fuel (oil or gas) is injected into the rarefied high-temperature air around. The fuel is burned under the lean oxygen (2-20%) state. At the same time, the burned hot flue gas in the furnace body passes through another heat-storage type burner A and is discharge into atmosphere. When the high-temperature flue gas in the furnace body passes through the heat-storage type burner A, the sensible heat is stored in the heat-storage type burner A and discharged through a reversal valve with the flue gas at a temperature below 150° C. The reversal valve at a low working temperature is switched at certain frequency, facilitating two heat-storage burners to be under the working state that heat is alternately stored and discharged. Therefore, the objectives of energy saving and reduced Nox emissions are achieved. The commonly used switching period is from 30 to 200 seconds.

Working Processes:

As shown in the arrows in FIGS. 2-3, after being charged, one burner begins to heat one of the two combustion chambers, the other burner does not work; hot flue gas produced by the combustion chamber heated enters into the flue gas chamber for reversing, and flows into the other burner not working through a flue gas heat radiation pipe with multiple combustion stages and the flue gas chamber; at the same time, the hot flue gas enters into the heat-transfer device of a heat storage body through the burner not working; reversed by the reversal valve, the burner working stops working burning, while the other burner begins to work. Similarly, hot flue gas produced by the other combustion chamber heated enters into the flue gas chamber for reversing, and flows into the other burner not working through a flue gas heat radiation pipe with multiple combustion stages and the flue gas chamber; at the same time, the hot flue gas enters into the heat-transfer device of a heat storage body through the burner stopped working. This cycle continues. The furnace is vacuumized while the cooling-off sleeve is being cooled down in the process of heating reduction.

When the reduction is completed, the end cover on the cooling-off sleeve is removed, the crystallization sleeve is taken out and the crystal (such as magnesium crystal) is taken out, then a slag discharge door is opened, and slags are discharged and carried away; The second round feeding and heating are carried out again after the crystallization sleeve is installed. This cycle continues.

When the furnace is used for heating water or producing steam, all of its flange and sealing ring connections are changed into welded connection; both the loading inlet and the discharge door on the furnace body is cancelled; such devices are arranged as below: a water inlet, a water outlet, a liquid level control system, a water supply system and a safety valve etc; the crystal collector is also cancelled; and the furnace body is changed from the suspension type to a frame-mounted type.

What is claimed is:

1. An energy efficient furnace with coaxial segmented center hearth and multiple combustion stages with regenerative heat return wherein comprising:

a metal furnace body whose inside is provided with a furnace chamber; the furnace chamber is divided into two sections at the middle by fire resistant material to form a left and a right independent combustion chambers; two independent combustion chambers are respectively connected with the ends of flue gas chambers, while the other ends of the flue gas chambers are respectively connected with a burner; the peripherals of two independent combustion chambers are respectively provided with a flue gas heat radiation pipe; a middle flue gas chamber is arranged in the middle position of the furnace chamber; two ends of the flue gas heat radiation pipe are respectively connected with the flue gas chamber and the middle flue gas chamber; two independent combustion chambers are communicated with each other through the flue gas chamber, the flue gas heat radiation pipe and the middle flue gas chamber, and combust alternately; when one combustion chamber combusts, the other combustion chamber stops combusting; hot flue gas produced by the combustion chamber is sucked into a heat-transfer device of a heat storage body through the flue gas chamber, the flue gas heat radiation pipe, the middle flue gas chamber, the heat radiation pipe, the flue gas chamber and the non-burning burner; a loading inlet and a crystal collector are arranged on the metal furnace body, a discharge port is arranged below the metal furnace body, and a suspending point is arranged on the surface of the metal furnace body;

a suspension device for suspending the metal furnace body horizontally or obliquely, including a portal frame; the metal furnace body is suspended on the portal frame at a suspending point; a walking mechanism and a feeding mechanism are also arranged on the portal frame;

a burner, including a nozzle, wherein the nozzle is provided with an igniter, a fuel inlet, a hot flue-gas inlet and a hot flue-gas outlet, wherein the hot flue-gas inlet and the hot flue-gas outlet are respectively connected with the heat-transfer device of a heat storage body.

2. The energy efficient furnace with coaxial segmented center hearth and multiple combustion stages with regenerative heat return according to claim 1, wherein both ends of the metal furnace body are respectively connected to a sealing head, the metal furnace body is tightly fixed with the sealing head by a quick locker and a tightener; the flue gas chamber is fixed inside the sealing head by a bushing; a seal cartridge is arranged between the flue gas chamber and the bushing of the sealing head; wherein, a connection flange is respectively arranged at both ends of the metal furnace body, the connection flange is provided with a wedge-shaped surface; the sealing head is provided with a flange of the sealing head, the flange of the sealing head is provided with a wedge-shaped surface; a cooling water channel is arranged on the connection surface between the connection flange and the flange of the sealing head, a cool water inlet and a cool water outlet which are communicated with the cooling water channel are respectively arranged on the connection flange and the flange of the sealing head;

the quick locker is provided with a quick latch segment; a V-shaped groove and a locking hole are arranged on the quick latch segment, the V-shaped groove is stuck on the wedge-shaped surface for connection of the connection flange and the flange of the sealing head, the steel wire rope of the tightener passes through the locking hole of the quick latch segment, in this way, the metal furnace body is tightly fixed to the sealing head.

3. The energy efficient furnace with coaxial segmented center hearth and multiple combustion stages with regenerative heat return according to claim 1, wherein the crystal collector is connected to the vacuum tube of the crystal collector by a V-shaped rapid coupling, the lower end of the vacuum tube of the crystal collector is connected with the metal furnace body, wherein, the crystal collector includes a cooling-off sleeve, inside of the cooling-off sleeve is provided with a tapered crystallization sleeve, the cooling-off sleeve is respectively provided with a cool water inlet, a cool water outlet and a vacuum port, wherein the cool water inlet is connected to a water pump, the cool water outlet is connected to a water tank, the vacuum port is connected to a vacuum pump, a port of the cooling-off sleeve is sealed and covered with an end cover, the lower end of the cooling-off sleeve is provided with a flange of the cooling-off sleeve, the flange of the cooling-off sleeve is provided with a wedge-shaped surface and a V-shaped connector;

the upper end of the vacuum tube of the crystal collector is provided with a flange of a vacuum collection tube, the flange of a vacuum collection tube is provided with a wedge-shaped surface and a V-shaped connecting base, the V-shaped connector is connected with the V-shaped connecting base, an O-ring seal is arranged on the junction surface between the V-shaped connector and the V-shaped connecting bas, the flange of the cooling-off sleeve is tightly fixed to the flange of a vacuum collection tube by the V-shaped rapid coupling on the wedge-shaped surface thereof.

4. The energy efficient furnace with coaxial segmented center hearth and multiple combustion stages with regenerative heat return according to claim 1, wherein the suspension device comprises a double-arch portal structure consisting of two portal frames; each of the portal frame is respectively provided with a suspension lifting ear; both ends of the metal furnace body are respectively provided with two suspending points, wherein one of the two suspending points is suspended on one suspension lifting ear of the portal frame by steel wire rope, while the other suspending point is connected to the other suspension lifting ear by steel wire rope and an electric block.

5. The energy efficient furnace with coaxial segmented center hearth and multiple combustion stages with regenerative heat return according to claim 1, wherein the heat-transfer device of a heat storage body includes a heat storage body A, a reversal valve and a heat storage body B, the burners at both ends of the combustion chambers alternatively work via the heat storage body A, the reversal valve and the heat storage body B respectively; each of burners on the two combustion chambers is respectively provided with a hot gas inlet and a hot gas outlet, both the heat storage body A and the heat storage body B are also respectively provided with a hot gas inlet and a hot gas outlet, the hot gas inlet and the hot gas outlet on a burner are connected to the reversal valve respectively through the hot gas inlets and the hot gas outlets of the heat storage body A and the heat storage body B.

6. The energy efficient furnace with coaxial segmented center hearth and multiple combustion stages with regenerative heat return according to claim 1, wherein the walking mechanism is suspended on the portal frame; the walking mechanism comprises an H-shaped steel; the H-shaped steel is sleeved with a U-shaped steel; a walking wheel is arranged on the U-shaped steel; the walking wheel strides across a lower beam of the H-shaped steel; a lifting ear connected with the electric block is arranged at the bottom of the U-shaped steel; and the lifting hook of the electric block is connected with the feeding mechanism through a steel rope of a hopper;

the feeding mechanism is provided with a hopper, the lower end of the hopper is provided with a discharge outlet; a bi-parting type discharge door is arranged on the discharge outlet; two ends of the bi-parting type discharge door are hinged on the discharge outlet; the bi-parting ends of the bi-parting type discharge door are connected together through the steel rope of the discharge door; and the steel rope of the discharge door is connected with the electric block through the steel rope of the hopper.

7. The energy efficient furnace with coaxial segmented center hearth and multiple combustion stages with regenerative heat return according to claim 1, wherein the loading inlet is provided with a cooling ring, the cooling ring is provided with a cooling water channel, a feeding door is arranged at the loading inlet, the feeding door is controlled by an electric actuator for opening or closing;

the discharge outlet is provided with a cooling ring, the cooling ring is provided with a cooling water channel, a discharge door is arranged at the discharge port, the discharge door is controlled by an electric actuator for opening or closing.

8. The energy efficient furnace with coaxial segmented center hearth and multiple combustion stages with regenerative heat return according to claim 1, wherein the metal furnace body is provided with a vibrator which drives the furnace body to vibrate.

9. The energy efficient furnace with coaxial segmented center hearth and multiple combustion stages with regenerative heat return according to claim 1, wherein inside the metal furnace body is provided with a thermal insulation material layer.

* * * * *